United States Patent [19]

Carbo et al.

[11] Patent Number: 4,507,339

[45] Date of Patent: Mar. 26, 1985

[54] COATED METAL CONTAINER AND METHOD OF MAKING THE SAME

[75] Inventors: Adelaida L. Carbo; Raymond H. Good, both of Barrington; Richard J. Karas, Addison, all of Ill.

[73] Assignee: American Can Company, Greenwich, Conn.

[21] Appl. No.: 551,082

[22] Filed: Nov. 14, 1983

Related U.S. Application Data

[63] Continuation of Ser. No. 339,634, Jan. 15, 1982, abandoned.

[51] Int. Cl.[3] ..... B32B 15/04

[52] U.S. Cl. ..... 428/35; 72/42; 72/46; 72/349; 220/453; 220/454; 220/456; 428/458; 428/464

[58] Field of Search ..... 72/349, 42, 46; 220/453, 454, 456; 428/35, 458, 461, 464

[56] References Cited

U.S. PATENT DOCUMENTS

| | | | |
|---|---|---|---|
| 3,360,157 | 12/1967 | Bolt et al. | 220/454 |
| 3,826,675 | 7/1974 | Smith et al. | 428/626 |
| 3,923,471 | 12/1975 | Smith et al. | 428/626 |
| 3,934,527 | 1/1976 | Saunders | 220/456 |
| 4,032,678 | 6/1977 | Perfetti et al. | 427/388 A |
| 4,062,312 | 12/1977 | Mason | 72/46 |
| 4,287,741 | 9/1981 | Peters et al. | 72/42 |

FOREIGN PATENT DOCUMENTS 1058454 7/1979 Canada .

*Primary Examiner*—John E. Kittle

*Attorney, Agent, or Firm*—Paul R. Audet; Ernestine C. Bartlett; Stuart S. Bowie

[57] ABSTRACT

A metal container comprising a seamless body and an end wall integral therewith and having on at least its interior surface a protective coating which is the reaction product of a citric acid ester utilized as a lubricant in forming the container and an after-applied synthetic resin.

10 Claims, No Drawings

COATED METAL CONTAINER AND METHOD OF MAKING THE SAME

This is a continuation, of application Ser. No. 339,634 abandoned, filed Jan. 15, 1982.

BACKGROUND OF THE INVENTION

The well known, three-piece, sheet metal, food container is fast being supplanted by a two-piece container having a seamless body with one end wall integral with the body and the other end wall secured to the body by means of a double seam after filling the container. Such containers for beer and soft drinks are made by the drawing and ironing process; whereas containers for fruits and vegetables which require a heavier and sturdier side wall are beginning to be made by a newer process known as draw/redraw.

Although the production of sheet metal containers by means of multiple draws is not new, the draw/redraw process is an improvement over the older drawing process in that it is done at higher speeds with greater draw ratios in each drawing step. Achieving this higher productivity-rate requires special machines and, inter alia, special lubricants for the metal-working operation; and to maintain this higher productivity-rate, subsequent processing steps to the formed container must also be at high speed or eliminated where possible.

U.S. Pat. No. 4,287,741 describes a class of citric acid esters which are effected as lubricants in the drawing and ironing process. We have found that the same citric acid esters are effective lubricants in the draw/redraw process described in relation to the present invention.

SUMMARY OF THE INVENTION

The present invention involves the discovery that the citric acid esters disclosed in U.S. Pat. No. 4,287,741 not only act as effective lubricants in the drawing and redrawing of ferrous metal stock to form a container, but that these lubricants, unlike metal-working lubricants used heretofore, need not be removed from the surface of the formed container, but may be made to react with a subsequently applied synthetic resin top coat by heating to form a hardened barrier layer over the interior surface of the container.

The citric acid esters useful in the present invention are disclosed in U.S. Pat. No. 4,287,741, which disclosure is incorporated herein by reference. This '741 patent gives the following structural formula for these esters:

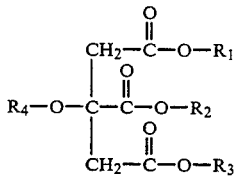

wherein $R_1$, $R_2$ and $R_3$ are selected from the group consisting of hydrogen and alcoholic residues containing 1–10 carbon atoms, $R_4$ is selected from the group consisting of hydrogen and carboxylic acid radicals containing 1–10 carbon atoms, and at least one of $R_1$, $R_2$ and $R_3$ is an alcoholic residue.

We have found that the method of the present invention is equally applicable to tinplated ferrous metal and to tin-free, low carbon sheet steel. Although the common prior art tinplate referred to in column 2, lines 50–56, of U.S. Pat. No. 4,287,741 is usable in the present invention, non-reflowed, matte finish tinplate described in U.S. Pat. No. 3,360,157 is preferred for the reasons set forth in this '157 patent in respect of the drawing and ironing process for making containers. The tin weight on the steel basis metal may vary from 0.10 lbs. per base box.

The preferred tin-free steel has a chromium surface treatment. While it is still in flat sheet form prior to its formation into a container, a synthetic resin base coat is applied and adhered to this treated surface. The most usual compositions for application as a base coat are those containing an epoxy resin or vinyl resin or polyester resin.

DETAILED DESCRIPTION OF THE INVENTION INCLUDING PREFERRED EMBODIMENTS

The tin-free steel preferred for use in the present invention is aluminum-killed, continuous cast steel with a chromium/chromium oxide surface treatment. The chromium in the oxide is present at about 0.5 to 2.0 mg per square feet and the chromium metal at about 3 to 13 mg per square foot. The material described is known in the art as TFS-CT for tin-free steel, chromium type. The treatment is described in a paper published in the Journal of the Electrochemical Society, Vol. 116, No. 9, pp 1299–1305.

The preferred tinplate has the same composition of steel as set forth above and at the steel mill in a well known manner has tin applied to its surface electrolytically in various amounts, for example, 0.25 lb. per base box. As mentioned previously, this tinplate is left in a matte condition, i.e., is not flow brightened, is oiled for rust inhibition and coiled for shipment to a container-making installation.

Thereafter the tin-free steel when received in the can-making plant has applied to its surfaces a base coating. The preferred coating contains an epoxy resin based on bisphenol A with an epoxide equivalent weight of 2300 to 4000, a urea-formaldehyde cross-linker, a sulfonic acid catalyst, and a high-melting polyethylene internal lubricant. The coating has a solids content of 28 percent. Both vinyl and polyester resin compositions have also been used as base coats.

This base coating applied to both sides of the steel may be applied while the steel is still in coil form or the steel may be cut into sheets and the coating applied to individual sheets, which coating is subsequently baked to form a tough, adherent base coat on the tin-free steel.

The citric acid ester of the present invention is dip coated onto both surfaces of individual sheets of the base coated tin-free steel, the excess ester is removed and the sheets are then fed into a blanking and cupping press which cuts from the sheet one or more circular discs of 7.947 inches in diameter, and draws the disc into a cup of 5.007 inches in diameter and 1.850 inches in side wall height. In two subsequent operations, the cup is successively reduced in diameter with concurrent lengthening of its side wall, i.e., drawn; and simultaneously this side wall is slightly thinned, i.e., to about 10% less than the starting gauge, and further elongated, i.e., ironed, in the manner similar to that described in U.S. Pat. No. 3,360,157. The final diameter and side wall height accomplished in the drawing plus ironing are 3.060 in. and 4.450 in. respectively and are accomplished in a few seconds. The diameter of the starting blank and the height to diameter ratios, draw ratios, in the ensuing metal working process may be varied depending upon the desired size of the finished can. Also, as between different draw/redraw systems, the amount of draw in each step may be varied provided the cumulative effect of the plural draws produces the can of desired height and diameter.

It is readily apparent that a draw/redraw system with ironing is a more severe metal working process than a draw/redraw system without ironing. The citrate ester lubricant of the present invention performs equally well in both systems.

The particular citric acid compound used in the above example is acetyl tributyl citrate. It may be applied by any suitable means such as roller coating, immersion coating with excess suitably removed, electrostatic deposition which is accurate in application both as to weight and placement, or by hot spraying from an oxy-dry unit or cold spraying if the ester is reduced with a suitable solvent.

The amount of lubricant applied over the base coat can vary from 10 to 40 and preferrably 10 to 20 milligrams per square foot of total surface, i.e., both sides, of the sheet being fed into the draw/redraw apparatus. It has been found that the lubricating effect falls off appreciably below 10 mgs/ft$^2$ and for most operations 20 mgs/ft$^2$ is sufficient to achieve the high speed, trouble free, multiple draws from flat blank to formed container. Due to the severity of the metal-working operation, i.e., the appreciable draw ratios and draw speed plus ironing, substantial heat is generated on the surfaces being worked. While not wishing to be bound by any particular theory, it is possible that this generated heat causes at least a partial decomposition of the lubricant on the worked surfaces, thereby liberating reactive substances such as those having carboxyl or acetyl functional groups. For example, in the case of the preferred acetyl tributyl citrate, acetic acid would be liberated. These functional groups are believed to attach themselves to the base coat and/or be available for reaction with the postsprayed top coating.

At the completion of the draw/redraw operation, the container is beaded to impart strength to the side and bottom walls before being fed into a device for applying a top coat to the container's inside surface. Most usually this device involves a turret which revolves the container past a reciprocating spray gun which enters the interior of the container which is spun on its longitudinal axis while the spray gun, as it is retracted from the container body, emits a 360 degree spray of a synthetic resin solution to coat the entire interior surface of the container.

After completion of the top coating operation, the container is then subjected to a temperature of 400° F. for 4 minutes to harden and cure the top coat. Unlike prior art procedures which require the metal-working lubricant to be removed before application of the top coat to avoid contamination and improper curing of the top coat, the procedure of the present invention not only eliminates the time-consuming step of removing the lubricant and permits the application of the top coat directly to a still-lubricated internal surface of the container but assists in firmly adhering the top coat to the base coat. Again, not wishing to be bound by any particular theory, it is believed that the reactive groups liberated from the applied lubricant previously and/or during the above mentioned baking operation react with or at least anchor themselves into the top coat as well as the base coat thereby forming a strong adhering medium between the base coat and top coat.

The citric acid ester lubricant and what remains thereof after the draw/redraw operation are soluble in organic solvents such as butanol, butyl Cellosolve, diisobutyl ketone, Cellosolve acetate and Solvesso 150. Therefore, resins for top coats which are also soluble in these same solvents and provide inert, continuous, resin films upon thermal curing are preferred such as epoxy resins and acrylic resins. Vinyl resins are usable if they are applied over a base other than a thermoset epoxy resin. The citric acid ester may also be used in water-base coating compositions provided the liquid system contains a solvent for the citrate ester which is miscible with the water of the system.

Evaluation of top coats applied over an epoxy-UF base coat is done by testing process resistance as well as intercoat adhesion between the base coat and the top coat. The following table summarizes the results of these tests:

Evaluation of Postsprayed Top Coats over an Epoxy type Base Coat

| Top Coat | Process Resistance | Intercoat Adhesion |
|---|---|---|
| acrylic | passed | passed |
| vinyl | passed | failed |
| epoxy-phenolic | passed | passed |
| epoxy-acrylic | passed | passed |
| epoxy-phenolic | passed | passed |
| epoxy-phenolic | passed | passed |
| epoxy-phenolic | passed | passed |
| epoxy | passed | passed |

The epoxy-phenolic resin systems in the above table differ from each other in the proportion of epoxy to phenolic.

Process resistance is checked by filling the container with deionized water followed by steam processing at 265° F. for 90 minutes. After water cooling and standing overnight, the cans are emptied, cut open, cross hatched, and taped to test intercoat adhesion.

Other suitable base coat/top coat combinations include vinyl and polyester resins as base coats, examples of which are in the table below:

Intercoat Adhesion After Process

| | Top Coat | | |
|---|---|---|---|
| Base Coat | Acrylic | Vinyl | Epoxy |
| polyester | passed | passed | passed |
| vinyl | passed | passed | passed |
| epoxy | passed | failed | passed |
| epoxy | passed | failed | passed |
| vinyl | passed | passed | passed |
| epoxy | passed | failed | passed |

The failures noted in the above table result from an attempt to adhere a thermoplastic, vinyl resin top coat to a thermoset, epoxy resin base coat. These failures are independent of the citrate ester lubricant of the present invention and would have occurred were the citrate ester not present.

Although the invention described above is in respect of a base coated tin-free steel, it is also applicable to the utilization of matte-finish, electrolytic tinplate as the metal starting material. As set forth in U.S. Pat. No. 3,360,157, the matte finished tinplate and a liquid lubricant act synergistically with each other and an analogous situation obtains in the instant invention betwen the matte tin and citrate ester to augment the lubricant system during the draw/redraw process for forming the container. Further, as theorized above, it is believed that functional groups, e.g., carboxyl and/or acetyl, formed either during the metal-working process or during the thermal hardening of the stop coat, or in both instances, form in effect anchoring chains to hold the top coat firmly adhered to the tinplate surface.

Consistent with this theory are the results of gas chromatographic and mass spectrometric analyses which indicate that acetic acid and butanol are formed and liberated from thermal degradation of acetyl tributyl citrate when it is heated to 195° C., the approximate temperature attained in the thermal cure of the top coat.

Furthermore, acetic and citric acids and butanol are produced by hydrolysis of the acetyl tributyl citrate with an amine, such as 2-amino-2-methyl propanol, a solvent generally used as a component of water-base coatings Comparative tests were run forming a base coated tin-free steel into containers by means of the draw/redraw with ironing process using various metal-working lubricants. In each instance except for the acetyl tributyl citrate (ATBC) of the instant invention, the lubricant either was inferior to the acetyl tributyl citrate as a metal-working lubricant as exemplified by the required longer time to produce the container or it was incompatible with the top coat preventing the top coat from forming a continuous protective film. The table set forth immediately below shows the results of these comparative tests:

EFFECT OF LUBRICANT TYPE ON DRAW/REDRAW AND IRONING TIN-FREE STEEL AND ELECTROLYTIC TINPLATE

| LUBRICANT | FABRICATION | ADHESION OF TOP COAT |
|---|---|---|
| Petrolatum (ETP) | Good | Very poor[1] |
| Butyl Stearate[2] (ETP) | Good | Good |
| Dioctyl Stearate[3] (ETP) | Good | Good |
| Neodene (α-olefin) (TFS) | Cracked domes; Broken radii | Good |
| Phosphate Ester (TFS) | Failure on Second Operation | — |
| Acetyl Tributyl Citrate (ETP) | Good | Good |
| ATBC with Carnauba wax (TFS) | Good | Good |
| Acetyl trihexyl citrate (TFS) | Good | Good |

Notes:
[1]No adhesion before or after process.
[2]Application problems due to rapid viscosity changes as solidification point (65° F.) is approached.
[3]Lower stability due to volatilization and oxidation (Ref: U.S. Pat. No. 3,923,471).

We believe another factor contributing to the effectiveness of acetyl tributyl citrate is its ability to increase the wettability of the TFS or ETP surface by the top coating as shown by the contact angle measurements in the table below. The measurements were taken by applying a coating of the listed lubricant to the metal surface, placing a drop of water on the lubricated surface and then measuring the angle between the lubricated surface and an intersecting line tangent to the curved surface of the water droplet. The greater the wettability of the lubricant, the flatter the water droplet and the less the angle.

CONTACT ANGLES

| LUBRICANT | PLATE | CONTACT ANGLE |
|---|---|---|
| None | TFS | 83.5 |
| Petrolatum | TFS | 96.7 |
| ATBC | TFS | 74.5 |
| None | ETP | 72.4 |
| Petrolatum | ETP | 84.5 |
| ATBC | ETP | 70.5 |
| ATBC with Carnauba Wax | ETP | 70.6 |
| Butyl Stearate | ETP | 77.0 |
| Dioctyl Stearate | ETP | 73.5 |
| Neodene | ETP | 79.5 |

High melting waxes can be added to the citrate ester lubricant in concentrations of up to about 2% of the ester solids to improve lubricity without adverse effects on intercoat adhesion.

It is understood that the invention is not confined to any particular embodiment described herein as illustrative of the invention but embraces all such modifications thereof as may come within a scope of the following claims.

We claim:

1. A method of forming a coated metal container which comprises the steps of:

(1) applying a lubricant comprising a citric acid ester to both surfaces of ferrous metal stock, said ester being applied in an amount within the range of 10 to 40 milligrams per square foot of the total metal stock surface;

(2) subjecting said lubricated metal stock to multiple drawing or drawing and ironing to form a seamless metal container;

(3) applying a synthetic resin coating as a top coat to at least the interior surface of said lubricated metal container without removing the lubricant from the container surface; and (4) subjecting the lubricated, coated container to elevated temperature to cure the topcoat, said lubricant being effective to react with said top coat resin to form a continuous, adhered film on the container surface.

2. The method of claim 1 wherein the ferrous metal stock is coated with a synthetic resin base coat prior to application of the citric ester lubricant with the proviso that when said top coat is a vinyl resin, said base coat is not a thermoset epoxy resin.

3. The method of claim 1 wherein said lubricant contains up to about 2% of high melting point wax based on the total weight of said ester and wax solids.

4. The method of claim 3 wherein said coated, lubricated metal stock in step (2) is cut into a circult flat blank; said blank is drawn into a shallow cup; and said shallow cup, in two subsequent operations, is successively drawn, redrawn and ironed in step (2).

5. The method of claim 3 wherein (a) said ferrous metal stock is electrolytic tin plate or tinless, low-carbon steel; (b) said synthetic resin base coat is of a resin selected from the group consisting of an epoxide resin, a polyester resin and a vinyl resin; and (c) said synthetic resin top coat is selected from the group consisting of an epoxide resin; a polyester resin; an acrylic resin; and a vinyl resin.

6. The method of claim 4 wherein said citric acid ester is acetyl tributyl citrate.

7. A method of forming a coated metal container which comprises the steps of:

(1) forming a synthetic resin base coat selected from a polyeste rsin, an epoxide resin and a vinyl resin on both surfaces of electrolytic tin-plate or tin-free steel stock;

(2) applying an acetyl tributyl citrate lubricant to the coated metal surfaces in an amount within the range of 10 to 40 milligrams per square foot of the total metal stock surfaces;

(3) cutting said coated, lubricated metal stock into a cirular flat blank;

(4) drawing said flat blank into a shallow cup;

(5) subjecting said shallow cup to two subsequent operations wherein it is successively drawn, redrawn and ironed to form a seamless metal container;

(6) applying a synthetic resin selected from an epoxide resin, a polyester resin, a vinyl resin or an acrylic resin coating as a top coat to at least the interior surface of said metal container without removing said acetyl butyl citrate lubricant from the surfaces of said container with the proviso that when said top coat is a vinyl resin, said base coat is not a thermoset epoxide resin;

(7) subjecting the lubricated, coated container to elevated temperature to cure the top coat and to effect reaction of said citrate ester with either the base coat, the top coat or both the top coat and base coat to form a continuous, adhered film on the container surface.

8. A coated, metal container having a continuous, adhered film on its surfaces produced by the method of claim 1.

9. A coated metal container having a continuous, adhered film on its surfaces produced by the method of claim 3.

10. A coated metal container having a continuous, adhered film on its surfaces produced by the method of claim 6.

* * * * *